US009370960B2

(12) United States Patent
Peyton et al.

(10) Patent No.: US 9,370,960 B2
(45) Date of Patent: Jun. 21, 2016

(54) BALLPOINT PEN WITH SLIDABLE CAP

(71) Applicants: Jerry F. Peyton, Oro Valley, AZ (US); Georgia C. Peyton, Oro Valley, AZ (US)

(72) Inventors: Jerry F. Peyton, Oro Valley, AZ (US); Georgia C. Peyton, Oro Valley, AZ (US); Lee Shadbolt, Tucson, AZ (US)

(73) Assignees: Jerry F. Peyton, Oro Valley, AZ (US); Georgia C. Peyton, Oro Valley, AZ (US)

( * ) Notice: Subject to any disclaimer, the term of this patent is extended or adjusted under 35 U.S.C. 154(b) by 0 days.

(21) Appl. No.: 14/806,506

(22) Filed: Jul. 22, 2015

(65) Prior Publication Data

US 2015/0321502 A1 Nov. 12, 2015

Related U.S. Application Data

(63) Continuation-in-part of application No. 14/398,302, filed as application No. PCT/US2013/039062 on May 1, 2013, now abandoned, which is a continuation-in-part of application No. 13/461,448, filed on May 1, 2012, now Pat. No. 8,641,308.

(51) Int. Cl.
*B43K 23/12* (2006.01)
*B43K 7/00* (2006.01)

(52) U.S. Cl.
CPC ..... *B43K 23/12* (2013.01); *B43K 7/005* (2013.01)

(58) Field of Classification Search
CPC ..... B43K 7/00; B43K 7/005; B43K 23/008; B43K 23/12; B43K 24/026
USPC ..... 401/117
See application file for complete search history.

(56) References Cited

U.S. PATENT DOCUMENTS

| | | | | |
|---|---|---|---|---|
| 866,148 | A * | 9/1907 | Levingston | B43K 24/026 15/435 |
| 2,435,185 | A | 1/1948 | Reynolds | |
| 2,941,511 | A | 6/1960 | Cieremans | |
| 3,740,159 | A | 6/1973 | Smagala-Romanoff | |
| 4,580,919 | A | 4/1986 | Ambasz | |
| 4,679,954 | A | 7/1987 | Ambasz | |
| 4,780,016 | A * | 10/1988 | Kim | B43K 23/12 401/116 |
| D321,718 | S | 11/1991 | Ambasz | |
| 6,830,402 | B2 | 12/2004 | Sunatori | |

* cited by examiner

*Primary Examiner* — Mark A Laurenzi
*Assistant Examiner* — Bradley Oliver

(57) ABSTRACT

A ballpoint pen system having a slidable pen cap. A ballpoint ink cartridge disposed inside a pen housing has a ballpoint tip protruding out of a pen housing anterior aperture. The pen cap is disposed on a pen housing anterior end for capping the ballpoint tip. At least one linear pen cap through-slot is disposed through a pen cap side surface. At least one raised stopper located on the pen housing near the pen housing anterior end is disposed through the through-slot of the pen cap such that linearly sliding the pen cap causes the pen cap to move longitudinally relative to the pen housing. Sliding the pen cap to an extended position causes the pen cap to cover the ballpoint tip. Sliding the pen cap to a retracted position causes the ballpoint tip to protrude from the pen cap anterior aperture.

18 Claims, 4 Drawing Sheets

BALLPOINT PEN WITH SLIDABLE CAP

CROSS REFERENCE

This application is a continuation-in-part and claims benefit of U.S. patent application Ser. No. 14/398,302, filed Oct. 31, 2014, which is a 371 of PCT/US13/39062 filed May 1, 2013, which claims benefit of U.S. patent application Ser. No. 13/461,448 filed May 1, 2012, the specification(s) of which is/are incorporated herein in their entirety by reference.

FIELD OF THE INVENTION

The present invention relates to ball point pens, in particular, to ball point pens with a slidable cap.

BACKGROUND OF THE INVENTION

The ever popular ballpoint pen has been in use since the late 1800s having representations of the modern version dating to the 1940s. Ballpoint pens typically have a writing instrument with an internal ink reservoir that dispenses ink from a tip having a roller ball. In the beginning, the ballpoint pen was developed as a fine writing utensil, but through the years a branch of ballpoint pens have been developed into inexpensive, yet versatile disposable pens mostly made of plastic. A primary advantage inherent to the ballpoint pen design, besides the low cost, includes a resistance to ink leakage. One drawback to the ballpoint pen is that the pen cap can be easily lost since that pen cap is separate from the pen. The present invention teaches a novel, yet inexpensive ballpoint pen system that is easy to use and that does not require removal or separation of the pen cap from the pen.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The subject disclosure may feature a ballpoint pen system that comprises a tubular pen housing having a ballpoint ink cartridge disposed therein and a pen cap for capping the ballpoint tip of the ballpoint ink cartridge.

Embodiments of the pen cap may comprise a pen cap posterior end with a pen cap posterior aperture disposed thereon, a pen cap anterior end with a pen cap anterior aperture disposed thereon, a cylindrical pen cap channel fluidly connecting the pen cap anterior aperture to the pen cap posterior aperture, and at least one linear pen cap through-slot disposed through a pen cap side surface. Preferably, the pen cap anterior aperture is sized to allow only the ballpoint tip to slidably pass through and the pen cap channel is sized to snugly and slidably interface with the pen housing exterior surface.

The pen housing may comprise at least one raised stopper located near a pen housing anterior end and disposed through the through-slot of the pen cap such that linearly sliding the pen cap causes the pen cap to move longitudinally relative to the pen housing. When the pen cap is slid in a first direction to engage the raised stopper with a slot posterior end, the pen cap is place in an extended position such that the pen cap covers the ballpoint tip, and the engagement of the raised stopper with the slot posterior end prevents the pen cap from being separated from the pen housing. When the pen cap is slid in a second direction opposite of the first direction to engage the raised stopper with the slot anterior end, the pen cap is place in a retracted position such that the ballpoint tip protrudes from the pen cap anterior aperture, and the pen cap posterior end interfaces with the pen housing shoulder.

DESCRIPTION OF PREFERRED EMBODIMENTS

Figure 1A:
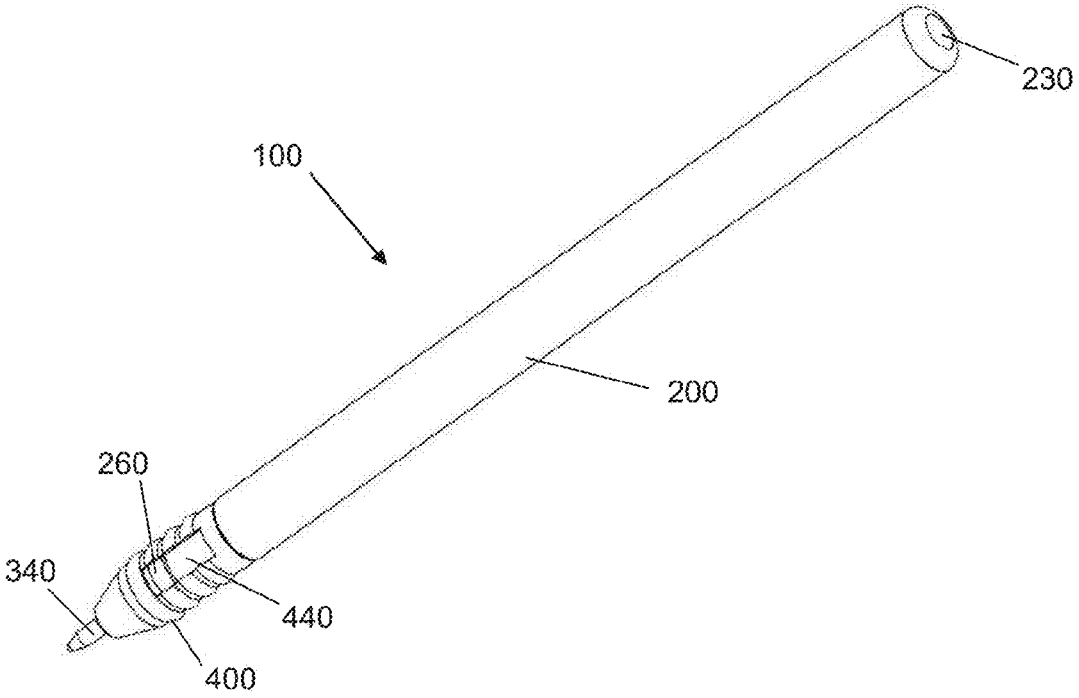
FIG. 1A shows a perspective view of the present invention with the cap in a retracted position.
Figure 1B:
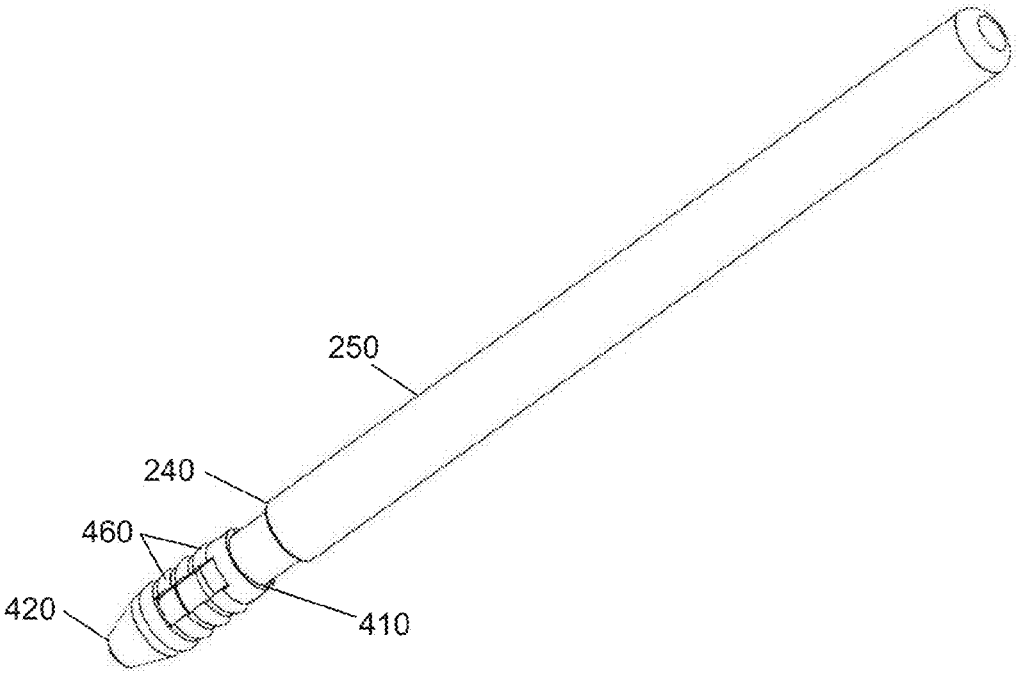
FIG. 1B shows a perspective view of the present invention with the cap in an extended position.
Figure 2A:
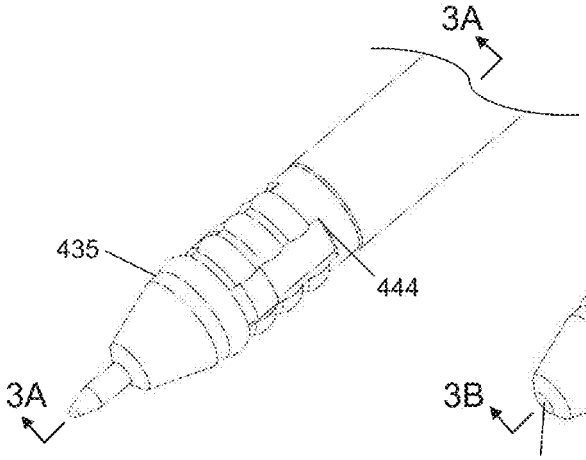
FIG. 2A shows a close-up perspective view of the present invention with the cap in a retracted position.
Figure 2B:
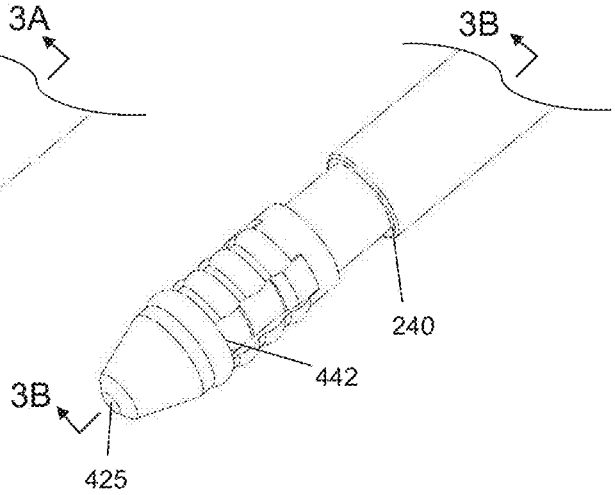
FIG. 2B shows a close-up perspective view of the present invention with the cap in an extended position.
Figure 3A:
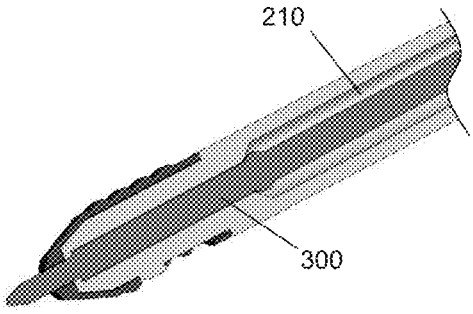
FIG. 3A shows a cross-sectional view of FIG. 2A.
Figure 3B:
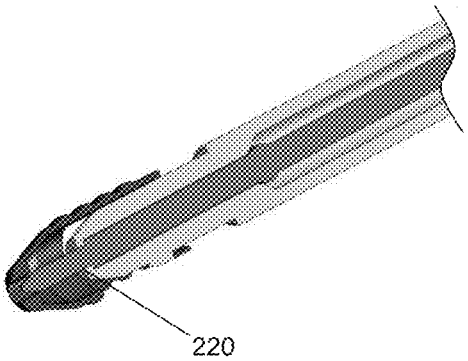
FIG. 3B shows a cross-sectional view of FIG. 2B.
Figure 4A:
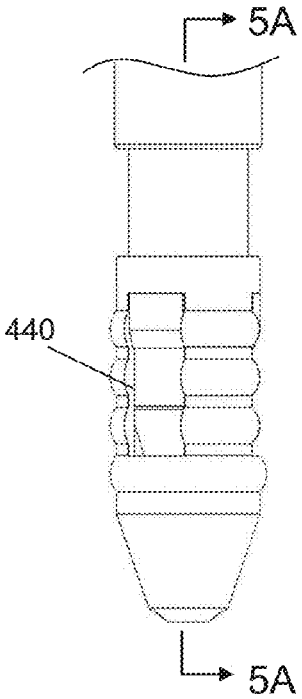
FIG. 4A shows a close-up side view of the present invention with the cap in a retracted position.
Figure 4B:
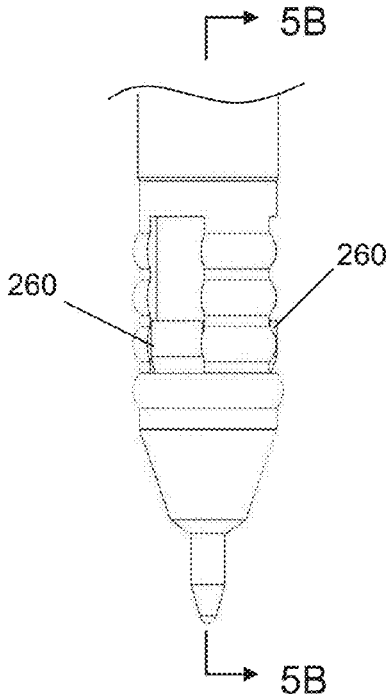
FIG. 4B shows a close-up side view of the present invention with the cap in an extended position.
Figure 5A:
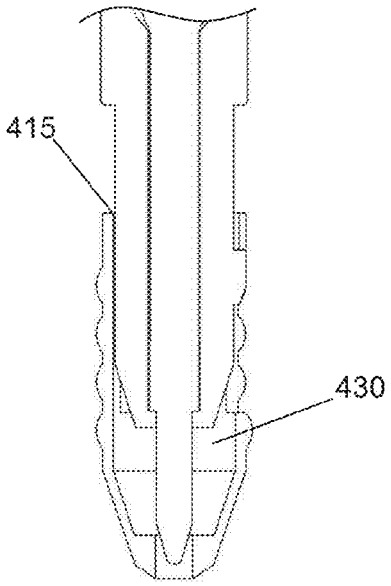
FIG. 5A shows a cross-sectional view of FIG. 4A.
Figure 5B:
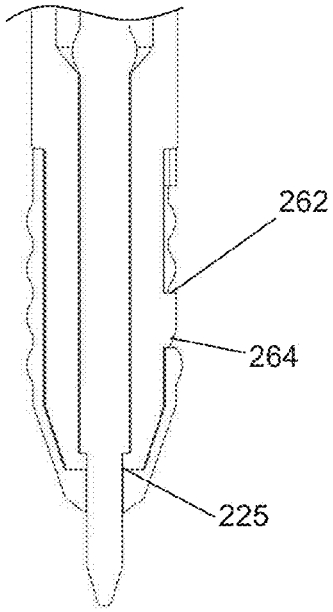
FIG. 5B shows a cross-sectional view of FIG. 4B.

Following is a list of elements corresponding to a particular element referred to herein:

100 ballpoint pen system
200 pen housing
210 pen housing cavity
220 pen housing anterior end
225 pen housing anterior aperture
230 pen housing posterior end
240 pen housing shoulder
250 pen housing exterior surface
260 raised stopper
262 flat square edge
264 beveled edge
300 ballpoint ink cartridge
340 ballpoint tip
400 pen cap
410 pen cap posterior end
415 pen cap posterior aperture
420 pen cap anterior end
425 pen cap anterior aperture
430 pen cap channel
435 pen cap side surface
440 pen cap through-slot
442 slot anterior end
444 slot posterior end
450 pen cap exterior surface
460 annular ridges Referring now to FIGS. 1-7, the present invention features a ballpoint pen system (100) comprising a tubular pen housing (200) with a ballpoint ink cartridge (300) disposed therein and a pen cap (400) for capping the ballpoint tip (340) of the ballpoint ink cartridge (300). In some embodiments, the tubular pen housing (200) may comprise a pen housing cavity (210) fluidly connected to a pen housing anterior aperture (225) disposed on a pen housing anterior end (220), a pen housing posterior end (230), a pen housing shoulder (240) radially disposed around a pen housing exterior surface (250) and proximal to the pen housing anterior end (220), and at least one raised stopper (260) protruding from the pen housing exterior surface (250) and disposed between the pen housing shoulder (240) and the pen housing anterior end (220).

In some embodiments, the ballpoint ink cartridge (300) has a ballpoint tip (340). Preferably, the ballpoint ink cartridge (300) is disposed in the pen housing cavity (210) such that only the ballpoint tip (340) projects through and away from the pen housing anterior aperture (225 while the remaining portions of the cartridge (300) are inside the pen housing cavity (210).

In some embodiments, the pen cap (400) is disposed on the pen housing anterior end (220) for capping the ballpoint tip (340). As a non-limiting example, the pen cap (400) may comprise a pen cap posterior end (410) with a pen cap posterior aperture (415) disposed thereon, a pen cap anterior end (420) with a pen cap anterior aperture (425) disposed thereon, a cylindrical pen cap channel (430) fluidly connecting the pen cap anterior aperture (425) to the pen cap posterior aperture (415), and at least one linear pen cap through-slot (440) disposed through a pen cap side surface (435). In some embodiments, the through-slot (440) may have a slot anterior end (442) biased towards the pen cap anterior end (420) and a slot posterior end (444) biased towards the pen cap posterior end (410). Preferably, the pen cap anterior aperture (425) is sized to allow only the ballpoint tip (340) to slidably pass through. In another preferred embodiment, the pen cap channel (430) is sized to snugly and slidably interface with the pen housing exterior surface (250).

Embodiments of the system (100) may feature the raised stopper (260) of the pen housing (200) disposed through the through-slot (440) of the pen cap (400) such that linearly sliding the pen cap (400) causes the pen cap (400) to move longitudinally relative to the pen housing (200). To illustrate the longitudinal movement of the pen cap (200), when the pen cap (400) is slid in a first direction to engage the raised stopper (260) with the slot posterior end (444), the pen cap (400) is place in an extended position such that the pen cap (400) covers the ballpoint tip (340), and the engagement of the raised stopper (260) with the slot posterior end (444) prevents the pen cap (400) from being separated from the pen housing (200). As used herein, the first direction is a direction away from the pen housing posterior end (230) and towards the pen housing anterior end (220). When the pen cap (400) is slid in a second direction opposite of the first direction to engage the raised stopper (260) with the slot anterior end (442), the pen cap (400) is place in a retracted position such that the ballpoint tip (340) protrudes from the pen cap anterior aperture (425), and the pen cap posterior end (410) interfaces with the pen housing shoulder (240).

In alternative embodiments, the pen housing (200) may have at least two raised stoppers (260) radially disposed thereon. The pen cap (400) may also comprise at least two linear through-slots (440) in alignment with the raised stoppers (260).

In another alternative embodiment, the pen housing (200) may comprise a plurality of raised stoppers (260) protruding from the pen housing exterior surface (250) and radially disposed between the pen housing shoulder (240) and the pen housing anterior end (220). Further to this embodiment, the pen cap (400) may comprise a plurality of linear pen cap through-slots (440) disposed through a pen cap side surface (435). Each through-slot (440) has a slot anterior end (442) biased towards the pen cap anterior end (420) and a slot posterior end (444) biased towards the pen cap posterior end (410). Preferably, the through-slots (440) are aligned with the raised stoppers (260) such that each raised stopper (260) is disposed through a through-slot (440). The pen cap (400) can be linearly slid and moved longitudinally relative to the pen housing (200). For example, when the pen cap (400) is slid in a first direction to engage the raised stoppers (260) with the slot posterior ends (444), the pen cap (400) is place in an extended position such that the pen cap (400) covers the ballpoint tip (340), and the engagement of the raised stoppers (260) with the slot posterior ends (444) prevents the pen cap (400) from being separated from the pen housing (200). When the pen cap (400) is slid in a second direction opposite of the first direction to engage the raised stoppers (260) with the slot anterior ends (442), the pen cap (400) is place in a retracted position such that the ballpoint tip (340) protrudes from the pen cap anterior aperture (425), and the pen cap posterior end (410) interfaces with the pen housing shoulder (240).

In other embodiments, the plurality of raised stoppers (260) may comprise two, three, or four linear plurality of raised stoppers (260). In still other embodiments, the plurality of linear pen cap through-slots (440) may comprise two, three, or four linear pen cap through-slots (440).

Embodiments of the ballpoint pen system (100) may feature the pen cap side surface (435) having a textured surface to enable a user to grip the pen cap (400) for writing. For example, the pen cap side surface (435) may comprise a plurality of annular ridges (460), such as two to five annular ridges, to enable a user to grip the pen cap (400) for writing. As another example, the pen cap side surface (435) may comprise a plurality of bumps or longitudinal ribs for gripping. Any suitable texture or pattern that provides a sufficiently non-sip surface may be used for the pen cap (400).

In some embodiments, the pen housing (200) can conically taper at or near the pen housing anterior end (220) such that the pen housing is narrowest at the pen housing anterior aperture (225). In other embodiment, the pen cap (400) can conically taper at or near the pen cap anterior end (420) such that the pen cap is narrowest at the pen cap anterior aperture (425).

In some embodiments, the raised stopper (260) may comprise a flat square edge (262) for engaging with the slot posterior end (444) to prevent separation of the pen cap (400) and the pen housing (200). In other embodiments, the raised stopper (260) may further comprise a bevelled edge (264) opposite of the flat square edge for engaging with the slot anterior end (442). The bevelled edge may provide ease of sliding the pen cap onto the pen housing during initial assembly of the system.

Figure 6:
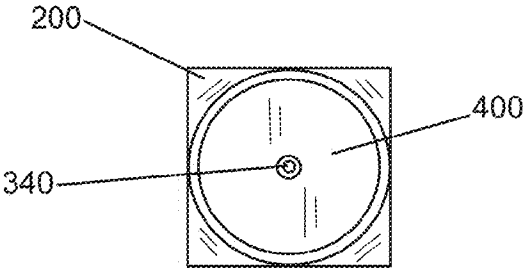
FIG. 6 shows an alternative embodiment of the present invention.
Figure 7:
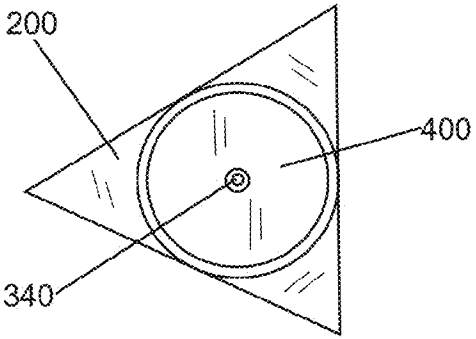
FIG. 7 shows an alternative embodiment of the present invention.

Preferred embodiments feature a pen housing (200) that is cylindrical in shape. Alternative embodiments may include the pen housing (200) that is in a shape of a rectangular prism or a triangular prism, as shown in FIGS. 6-7. In other embodiments, the pen cap (400) may be cylindrical in shape or in the shape of a rectangular prism or triangular prism. In one embodiment, the pen cap through-slot (440) is rectangular in shape. In another embodiment, the pen cap through-slot (440) is in the shape of an elongated oval.

In some embodiments, the raised stopper (260) may be rectangular, square, or circular in shape when viewed directly from a side view. Preferably, the raised stopper (260) has a width or diameter that is about equal to the width of the through-slot (440) such that the raised stopper (260) snugly fits through the through-slot and there is minimal to no latitudinal movement of the pen cap relative to the pen housing (200). In further embodiments, the raised stopper (260) can be located at a distance of about ¼ inch to about 1 inch away from the pen housing anterior end (220). For example, the raised stopper (260) is located at a distance of about ½ inch away from the pen housing anterior end (220).

In other embodiments, when the pen cap (400) is moved from the retracted position to the extended position or vice versa, a distance between the retracted position and the extended position of the pen cap (400) can be about ¼ inch, about ⅜ inch, about ½ inch, or greater than about ½ inch.

As used herein, the term "about" refers to plus or minus 10% of the referenced number. For example, an embodiment featuring the pen housing at about 10 inches in length includes a pen housing that is between 9 and 11 inches in length.

The disclosures of the following U.S. Patents are incorporated in their entirety by reference herein: U.S. Pat. No. 2,941,511 and U.S. Pat. No. 2,435,185.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of", and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A ballpoint pen system (100) comprising:

a. a tubular pen housing (200) comprising:

i. a pen housing cavity (210);

ii. a pen housing anterior end (220) having a pen housing anterior aperture (225) disposed thereon, wherein the pen housing cavity (210) is fluidly connected to the pen housing anterior aperture (225);

iii. a pen housing posterior end (230);

iv. a pen housing shoulder (240) radially disposed around a pen housing exterior surface (250) and proximal to the pen housing anterior end (220); and v. at least one raised stopper (260) protruding from the pen housing exterior surface (250), wherein the raised stopper (260) is disposed between the pen housing shoulder (240) and the pen housing anterior end (220);

b. a ballpoint ink cartridge (300) having a ballpoint tip (340), wherein the ballpoint ink cartridge (300) is disposed inside the pen housing cavity (210) such that only the ballpoint tip (340) projects through and away from the pen housing anterior aperture (225); and c. a pen cap (400) disposed on the pen housing anterior end (220) for capping the ballpoint tip (340), wherein the pen cap (400) comprises:

i. a pen cap posterior end (410) with a pen cap posterior aperture (415) disposed thereon;

ii. a pen cap anterior end (420) with a pen cap anterior aperture (425) disposed thereon, wherein the pen cap anterior aperture (425) is sized to allow only the ballpoint tip (340) to slidably pass through;

iii. a cylindrical pen cap channel (430) fluidly connecting the pen cap anterior aperture (425) to the pen cap posterior aperture (415), wherein the pen cap channel (430) is sized to snugly and slidably interface with the pen housing exterior surface (250); and iv. at least one linear pen cap through-slot (440) disposed through a pen cap side surface (435), wherein the through-slot (440) is rectangular in shape, wherein the through-slot (440) has a slot anterior end (442) biased towards the pen cap anterior end (420) and a slot posterior end (444) biased towards the pen cap posterior end (410);

wherein the raised stopper (260) of the pen housing (200) is disposed through the through-slot (440) of the pen cap (400) such that linearly sliding the pen cap (400) causes the pen cap (400) to move longitudinally relative to the pen housing (200), wherein the raised stopper (260) has a width about equal to a width of the through-slot (440) such that the raised stopper (260) snugly fits through the through-slot to prevent latitudinal movement of the pen cap relative to the pen housing (200), wherein when the pen cap (400) is slid in a first direction to engage the raised stopper (260) with the slot posterior end (444), the pen cap (400) is place in an extended position such that the pen cap (400) covers the ballpoint tip (340), and the engagement of the raised stopper (260) with the slot posterior end (444) prevents the pen cap (400) from being separated from the pen housing (200), and wherein when the pen cap (400) is slid in a second direction opposite of the first direction to engage the raised stopper (260) with the slot anterior end (442), the pen cap (400) is place in a retracted position such that the ballpoint tip (340) protrudes from the pen cap anterior aperture (425), and the pen cap posterior end (410) interfaces with the pen housing shoulder (240).

2. The ballpoint pen system (100) of claim 1, wherein the pen cap side surface (435) is textured to enable a user to grip the pen cap (400) for writing.

3. The ballpoint pen system (100) of claim 1, wherein the pen cap side surface (435) comprises a plurality of annular ridges (460) to enable a user to grip the pen cap (400) for writing.

4. The ballpoint pen system (100) of claim 1, wherein the pen housing (200) conically tapers near the pen housing anterior end (220) and is narrowest at the pen housing anterior aperture (225), and wherein the pen cap (400) conically tapers near the pen cap anterior end (420) and is narrowest at the pen cap anterior aperture (425).

5. The ballpoint pen system (100) of claim 1, wherein the raised stopper (260) comprises a flat square edge (262) for engaging with the slot posterior end (444) to prevent separation of the pen cap (400) and the pen housing (200), and an opposing bevelled edge (264) for engaging with the slot anterior end (442).

6. The ballpoint pen system (100) of claim 1, wherein the pen housing (200) is cylindrical in shape.

7. The ballpoint pen system (100) of claim 1, wherein the pen housing (200) is in a shape of a rectangular prism.

8. The ballpoint pen system (100) of claim 1, wherein the pen housing (200) is in a shape of a triangular prism.

9. The ballpoint pen system (100) of claim 1, wherein the pen housing (200) comprises at least two raised stoppers (260) radially disposed thereon, and wherein the pen cap (400) comprises at least two linear through-slots (440) in alignment with the raised stoppers (260).

10. The ballpoint pen system (100) of claim 1, wherein the pen housing (200) is cylindrical in shape.

11. The ballpoint pen system (100) of claim 1, wherein the pen housing (200) is in a shape of a rectangular prism.

12. The ballpoint pen system (100) of claim 1, wherein the pen housing (200) is in a shape of a triangular prism.

13. The ballpoint pen system (100) of claim 1, wherein the pen housing (200) comprises three raised stoppers (260), and wherein the pen cap (400) comprises three through-slots (440).

14. A ballpoint pen system (100) comprising:

a. a tubular pen housing (200) comprising:

i. a pen housing cavity (210);

ii. a pen housing anterior end (220) having a pen housing anterior aperture (225) disposed thereon, wherein the pen housing cavity (210) is fluidly connected to the pen housing anterior aperture (225);

iii. a pen housing posterior end (230);

iv. a pen housing shoulder (240) radially disposed around a pen housing exterior surface (250) and proximal to the pen housing anterior end (220); and v. a plurality of raised stoppers (260) protruding from the pen housing exterior surface (250), wherein the raised stoppers (260) are radially disposed between the pen housing shoulder (240) and the pen housing anterior end (220);

b. a ballpoint ink cartridge (300) having a ballpoint tip (340), wherein the ballpoint ink cartridge (300) is disposed inside the pen housing cavity (210) such that only the ballpoint tip (340) projects through and away from the pen housing anterior aperture (225); and c. a pen cap (400) disposed on the pen housing anterior end (220) for capping the ballpoint tip (340), wherein the pen cap (400) comprises:

i. a pen cap posterior end (410) with a pen cap posterior aperture (415) disposed thereon;

ii. a pen cap anterior end (420) with a pen cap anterior aperture (425) disposed thereon, wherein the pen cap anterior aperture (425) is sized to allow only the ballpoint tip (340) to slidably pass through;

iii. a cylindrical pen cap channel (430) fluidly connecting the pen cap anterior aperture (425) to the pen cap posterior aperture (415), wherein the pen cap channel (430) is sized to snugly and slidably interface with the pen housing exterior surface (250); and iv. a plurality of linear pen cap through-slots (440) disposed through a pen cap side surface (435), wherein each through-slot (440) is rectangular in shape, wherein each through-slot (440) has a slot anterior end (442) biased towards the pen cap anterior end (420) and a slot posterior end (444) biased towards the pen cap posterior end (410);

wherein the through-slots (440) are aligned with the raised stoppers (260) such that each raised stopper (260) is disposed through the through-slot (440), wherein linearly sliding the pen cap (400) causes the pen cap (400) to move longitudinally relative to the pen housing (200), wherein each raised stopper (260) has a width about equal to a width of the through-slot (440) such that each raised stopper (260) snugly fits through the through-slot to prevent latitudinal movement of the pen cap relative to the pen housing (200), wherein when the pen cap (400) is slid in a first direction to engage the raised stoppers (260) with the slot posterior ends (444), the pen cap (400) is place in an extended position such that the pen cap (400) covers the ballpoint tip (340), and the engagement of the raised stoppers (260) with the slot posterior ends (444) prevents the pen cap (400) from being separated from the pen housing (200), and wherein when the pen cap (400) is slid in a second direction opposite of the first direction to engage the raised stoppers (260) with the slot anterior ends (442), the pen cap (400) is place in a retracted position such that the ballpoint tip (340) protrudes from the pen cap anterior aperture (425), and the pen cap posterior end (410) interfaces with the pen housing shoulder (240).

15. The ballpoint pen system (100) of claim 14, wherein the pen cap side surface (435) is textured to enable a user to grip the pen cap (400) for writing.

16. The ballpoint pen system (100) of claim 14, wherein the pen cap side surface (435) comprises a plurality of annular ridges (460) to enable a user to grip the pen cap (400) for writing.

17. The ballpoint pen system (100) of claim 14, wherein the pen housing (200) conically tapers near the pen housing anterior end (220) and is narrowest at the pen housing anterior aperture (225), and wherein the pen cap (400) conically tapers near the pen cap anterior end (420) and is narrowest at the pen cap anterior aperture (425).

18. The ballpoint pen system (100) of claim 14, wherein each raised stopper (260) comprises a flat square edge (262) for engaging with the slot posterior end (444) to prevent separation of the pen cap (400) and the pen housing (200), and an opposing bevelled edge (264) for engaging with the slot anterior end (442).

* * * * *